US009352754B2

(12) United States Patent
Buse

(10) Patent No.: US 9,352,754 B2
(45) Date of Patent: May 31, 2016

(54) VEHICLE LINE

(76) Inventor: Hans-Joachim Buse, Brakel (DE)

( * ) Notice: Subject to any disclaimer, the term of this patent is extended or adjusted under 35 U.S.C. 154(b) by 103 days.

(21) Appl. No.: 14/353,352

(22) PCT Filed: Oct. 26, 2011

(86) PCT No.: PCT/EP2011/005403

§ 371 (c)(1),
(2), (4) Date: Jul. 29, 2014

(87) PCT Pub. No.: WO2013/060344

PCT Pub. Date: May 2, 2013

(65) Prior Publication Data

US 2015/0144021 A1 May 28, 2015

(51) Int. Cl.

| | |
|---|---|
| ***B61B 13/00*** | (2006.01) |
| ***B61B 13/06*** | (2006.01) |
| ***E01B 26/00*** | (2006.01) |
| ***E01B 2/00*** | (2006.01) |

(52) U.S. Cl.
CPC . *B61B 13/06* (2013.01); *E01B 2/00* (2013.01); *E01B 26/00* (2013.01)

(58) Field of Classification Search
CPC ..... B61B 13/06; E01B 2/00; E01B 26/00
See application file for complete search history.

(56) References Cited

U.S. PATENT DOCUMENTS

| | | | | |
|---|---|---|---|---|
| 3,760,741 | A * | 9/1973 | Belcher | B65D 19/38 104/135 |
| 4,537,577 | A * | 8/1985 | Sansome | A63H 18/08 104/120 |
| 4,739,711 | A * | 4/1988 | Mair | C21C 1/06 105/355 |
| 4,759,676 | A * | 7/1988 | Hammond | B65G 11/203 108/57.15 |
| 5,409,096 | A * | 4/1995 | Clopton | B65G 17/002 193/35 A |
| 2003/0000415 | A1* | 1/2003 | Lamb | B60L 13/04 104/281 |
| 2006/0236890 | A1* | 10/2006 | Lamb | B60L 13/04 104/282 |
| 2007/0289477 | A1* | 12/2007 | Sobolewski | B60F 1/005 105/215.2 |
| 2009/0020033 | A1* | 1/2009 | Miller | E01B 25/32 104/281 |
| 2010/0031846 | A1* | 2/2010 | Loser | B60L 13/03 104/281 |
| 2015/0144021 | A1* | 5/2015 | Buse | E01B 26/00 104/120 |

FOREIGN PATENT DOCUMENTS

| | | |
|---|---|---|
| EP | 1 355 008 A1 | 10/2003 |
| EP | 1 253 245 B1 | 12/2006 |
| FR | 2 808 292 A1 | 11/2001 |

OTHER PUBLICATIONS

International Preliminary Report on Patentability for International (PCT) Patent Application No. PCT/EP2011/005403 mailed May 8, 2014, 10 pages.

International Search Report prepared by the European Patent Office on Jul. 13, 2012, for International Application No. PCT/EP2011/005403.

* cited by examiner

*Primary Examiner* — Jason C Smith
(74) *Attorney, Agent, or Firm* — Sheridan Ross P.C.

(57) ABSTRACT

The present invention refers to a vehicle line comprising at least two rails which are parallel to each other and fastened to a substructure and on which plate-shaped elements are arranged, characterized in that in the lateral lower portion the plate-shaped elements respectively comprise downwardly projecting bearing blocks which are supported in a vertically adjustable manner on holding elements which are respectively fastened to one of the rails.

20 Claims, 4 Drawing Sheets

VEHICLE LINE

CROSS REFERENCE TO RELATED APPLICATIONS

This application is a national stage application under 35 U.S.C. 371 and claims the benefit of PCT Application No. PCT/EP2011/005403 having an international filing date of Oct. 26, 2011, which designated the United States, the disclosure of which is incorporated herein by reference.

The present invention refers to a vehicle line comprising at least two rails which are parallel to each other and fastened to a substructure and on which plate-shaped elements are arranged.

EP 1 253 245 B1 describes a method for the use of tracks, in which method finished parts are placed on the tracks which can be used as a driveway or footpath or in an alternative way. In such a construction, the finished parts are just placed on the surface of the rails; they are here only fixed to prevent lateral slippage. This kind of configuration does not permit any dynamic load.

It is the object of the present invention to provide a vehicle line of the afore-mentioned type which withstands complex loads and is particularly suited for use by rapidly moving vehicles.

According to the invention this object is achieved by way of the feature combination of claim 1; the sub-claims show further advantageous configurations of the invention.

Hence, according to the invention it is intended that in the lateral lower portion the plate-shaped elements respectively comprise downwardly projecting bearing blocks which are supported in a vertically adjustable manner on holding elements which are respectively fastened to one of the rails.

Hence, according to the invention a construction is provided in which holding elements are fastened to the rails and carry the further construction. Said holding elements may be arranged in a suitable number on the rails. It is thereby possible to arrange, space-apart and dimension the holding elements such that the necessary bearing loads can be transmitted.

In a particularly advantageous configuration of the invention it is intended that the holding elements are mechanically connected to the rails, e.g. by way of screwing. It is however also possible to connect the holding elements firmly to the rails, e.g. by means of a weld joint. A firm construction which cannot be disassembled and which, although a subsequent disassembly or adjustment is not intended, may be of advantage with respect to the exact positioning of the holding elements is thereby chosen.

When the holding elements are mechanically anchored to the rails, e.g. by screws, or the like, it is possible to replace the holding elements or to adjust their position. It is thereby also possible to use differently worn rail profiles for the mounting of the vehicle line.

According to the invention the holding elements support the plate-shaped elements. These comprise downwardly projecting bearing blocks which are supported and guided in the holding elements. It is thereby possible to exactly position and to fix the plate-shaped elements both in the longitudinal direction and in the transverse direction of the rails and, in addition, to adjust the height. The latter is particularly of advantage whenever the (old) rails to be used or their substructure are no longer positioned in an accurate way. Also in the case of an elevation for cornering purposes, or the like, a vertical adjustability turns out to be particularly advantageous.

A further aspect of the vertical adjustability between the bearing blocks and the holding elements is that it is possible to finely adjust the vehicle line also after a given operating time and thus e.g. to compensate for a subsiding substructure.

A further, essential advantage of the use of the holding elements according to the invention is that the individual plate-shaped elements can each be disassembled individually, for instance for carrying out maintenance work. Since the holding elements firmly remain on the rails, the plate-shaped elements can subsequently be mounted again in a simple manner and find their previous exact position.

It is particularly advantageous when an adjusting element which is in abutment with the holding element is provided on the respective bearing block. Said element may e.g. be configured in the form of a threaded element, e.g. in the form of a screw. Hence, it is possible in an advantageous configuration of the invention to carry out a simple vertical adjustment by means of a screw which at least partly passes through the plate-shaped element. The threaded element (screw) may e.g. be provided with a round thread, a self-locking thread and/or an anti-twist device. Hence, it is prevented that an undesired automatic displacement takes place during dynamic loads on the vehicle line.

Furthermore, it is intended in a particularly advantageous configuration of the invention that a damping element is arranged between the rail and the holding element. Said damping element can preferably be provided in the form of an elastic element, e.g. a rubber element, a plastic element or an elastic metallic element. This provides for a reliable damping of vibrations that may arise while the vehicle line is being travelled along. This improves the riding comfort on the one hand and spares the rails and the substructure on the other hand.

To improve the vertical setting and adjustment of the plate-shaped element, it is intended in an advantageous configuration that the threaded element comprises an upwardly oriented operating portion which can be operated through a recess of the plate-shaped element. Hence, it is possible in a particularly simple manner to adjust the position from the top side of the plate-shaped elements. This can also be carried out automatically by means of suitable devices, so that an existing vehicle line according to the invention can be readjusted after its completion or at predetermined maintenance intervals.

To be able to transmit adequate transverse forces, it is further intended in an advantageous configuration of the invention that the bearing block is arranged to be vertically displaceable in a recess of the holding element. Hence, similar to a telescopic guidance, the bearing block is sliding in the holding element, so that the positioning as well as the contact surfaces needed for force transmission can be configured in an optimum way.

The vehicle line according to the invention is particularly suited for the use of disused tracks. These can often no longer be used in an optimum way due to wear of the rails and/or of the substructure; the efforts taken for a new production are not justified by the use that is then possible. The vehicle line according to the invention offers a simple and inexpensive remedy. A railroad on which e.g. magnetic levitation trains can run at a high speed is implemented by the mounting of the plate-shaped elements. It may be particularly advantageous for this variant of use to provide the plate-shaped elements with power rails, levitation magnets, guidance magnets or stator packs. These may serve the usual driving of magnetic levitation vehicles and may be fastened either separately to the plate-shaped elements or may be integrated into said elements. In the case of an integrated solution it is particularly advantageous when electrical connection elements are provided between the individual plate-shaped elements to ensure an uninterrupted power supply. With such a solution, it may also be particularly advantageous to electrically insulate used (old) rails relative to the holding elements and/or the plate-shaped elements.

The vehicle line according to the invention is particularly also useable for underground trains; here especially magnetic levitation trains.

According to the invention the plate-shaped elements may have any desired length, e.g. between 5 m and 10 m, but it is also possible to realize much longer plate-shaped elements as modules, e.g. with lengths of up to 30 m. This permits a faster construction of the vehicle line according to the invention.

Thus, the vehicle line according to the invention makes it possible to re-use existing railroad lines, particularly disused railroad lines, in a technically sophisticated manner, especially for magnetic levitation trains which can realize much higher speeds than would be possible with rail-bound vehicles on the old rails.

The invention will be described hereinafter with reference to an embodiment in conjunction with the drawing, in which.

Figure 1:
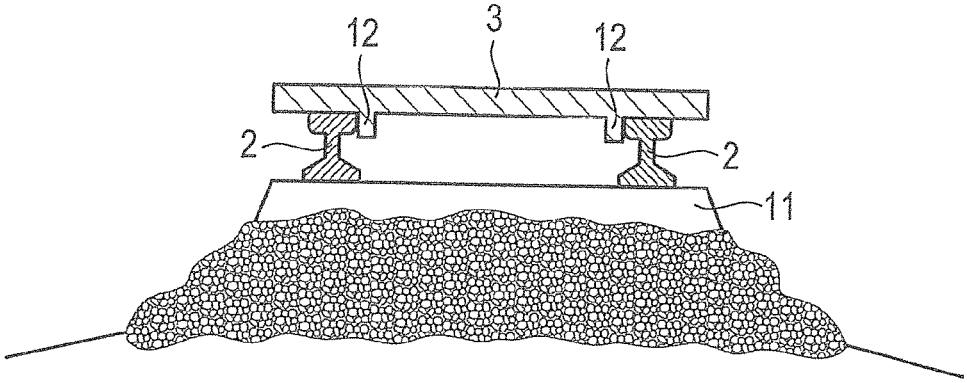
Fig. 1 PRIOR ART
FIG. 1 is a simplified sectional view of a construction known from the prior art.
Figure 2:
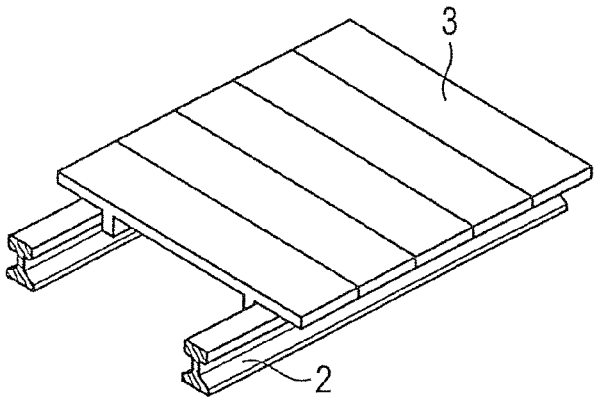
Fig. 2 PRIOR ART
FIG. 2 is a perspective view according to FIG. 1.

FIG. 1 is a sectional view showing a standard substructure of a railroad route, e.g. with gravel. Ties 11 are embedded in the substructure and have rails 2 mounted thereon in the standard way. Plate-shaped elements 3 are placed on the rails 2, as is also shown in FIG. 2. The plate-shaped elements 3 are provided on their bottom side with respective bounds 12 which prevent lateral slippage of the plate-shaped elements 3. Such constructions are not suited for dynamic loads; rather, they are mostly just good enough for static loads.

Figure 3:
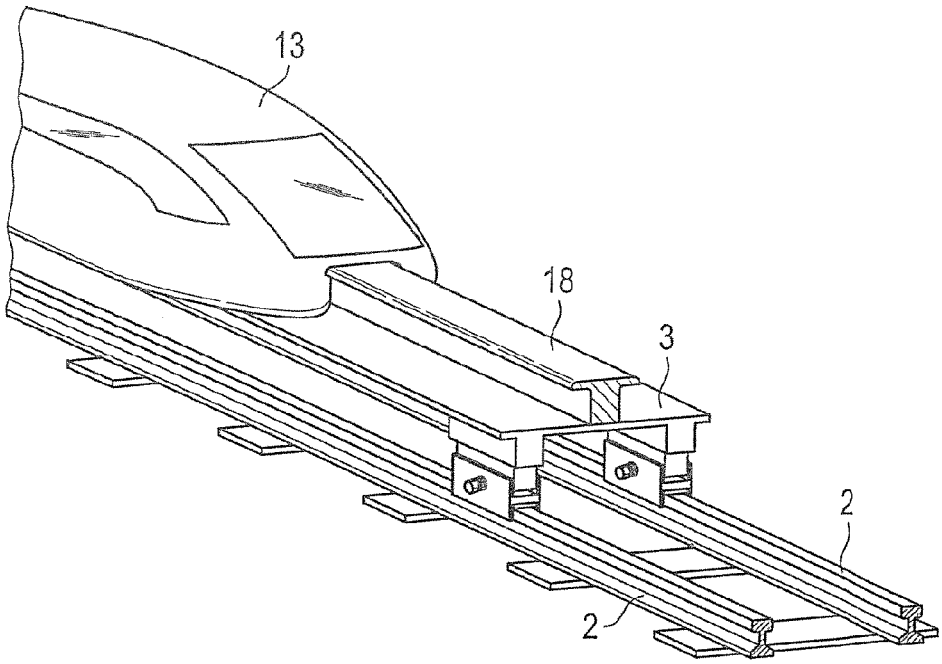
FIG. 3 is a perspective view of a possible use according to the invention.

FIG. 3 shows a perspective, simplified embodiment of the invention with use for a magnetic levitation vehicle 13.

Figure 4:
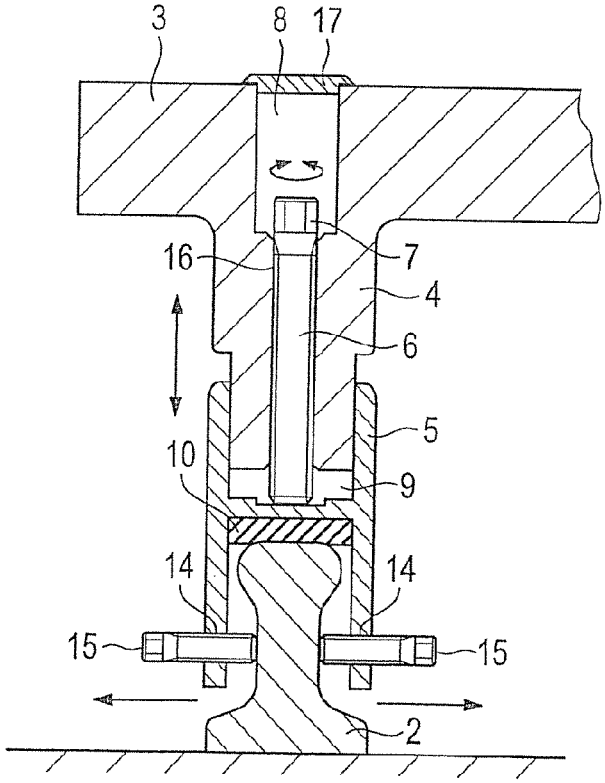
FIG. 4 is a sectional view of an embodiment according to the invention.
Figure 5:
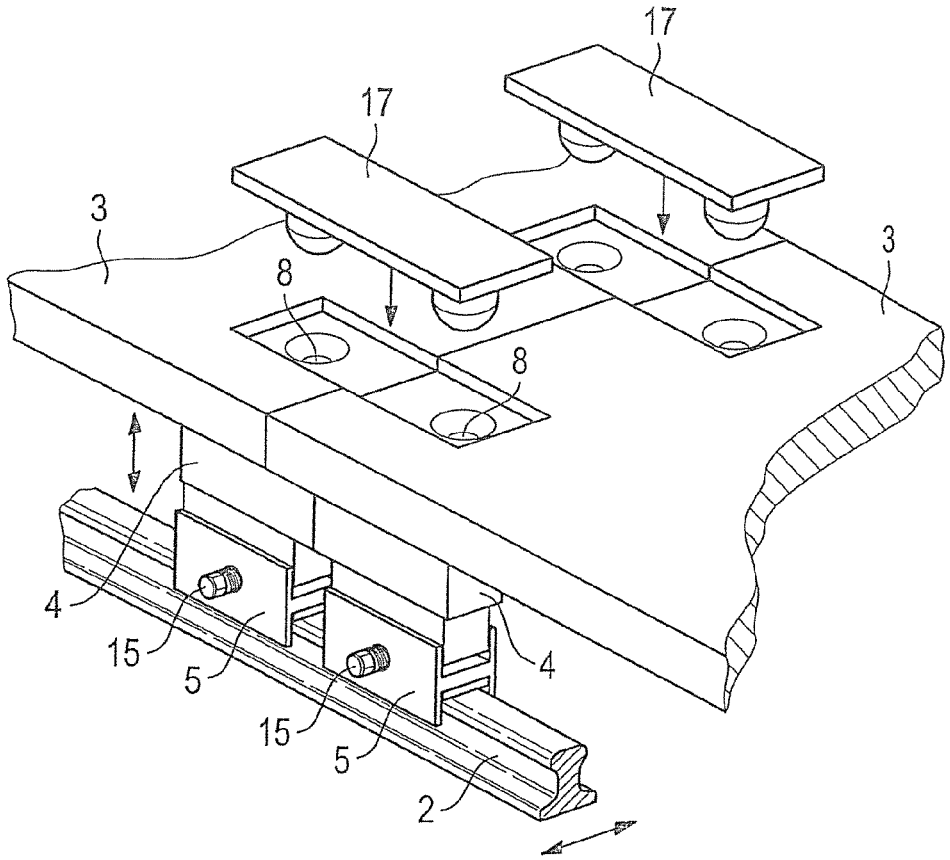
FIG. 5 is a perspective partial view of the embodiment shown in FIG. 4.
Figure 6:
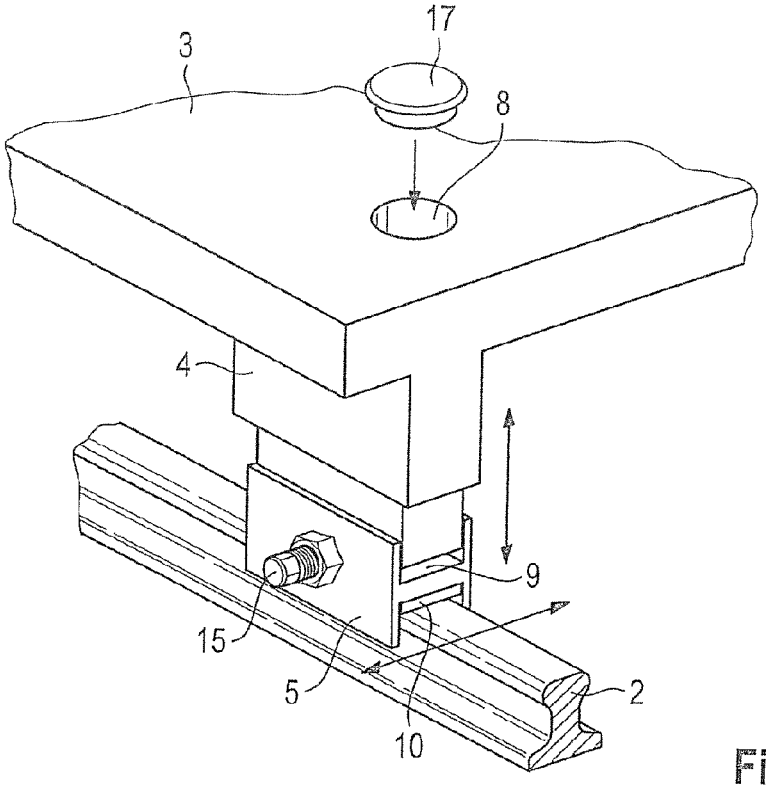
FIG. 6 is a further perspective partial view of the embodiment of FIGS. 4 and 5.
Figure 7:
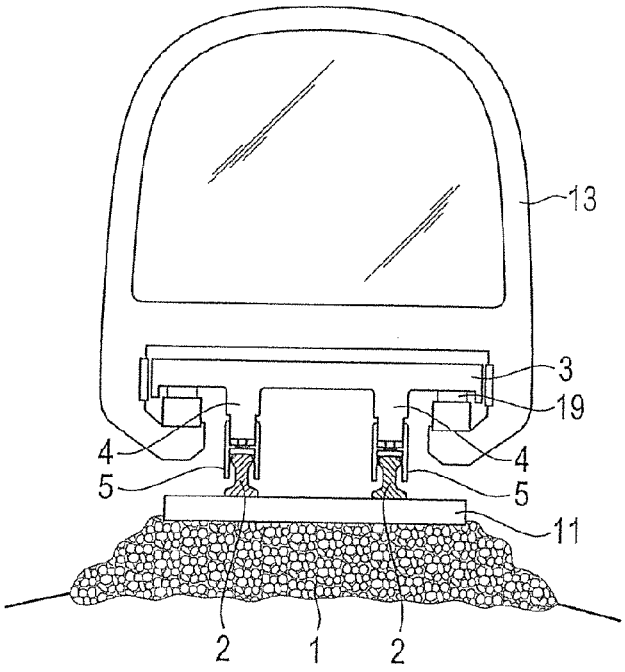
FIG. 7 is a simplified schematic sectional view of an embodiment of the vehicle line according to the invention with a magnetic levitation vehicle.

FIGS. 4 to 6 show in detail an embodiment of the invention. Shown is here a rail 2 on which or to which a holding element 5 is fastened. The holding element 5 has a substantially H-shaped cross-section. Its lower legs are provided with threaded recesses 14 into which lateral screws 15 or threaded bolts are screwed. Due to the rail profile, which has a smaller width in its central portion, the holding element 5 is thereby firmly and reliably fixed.

A damping element 10 which is e.g. made of rubber or plastic is arranged between the top side of the rail 2 and the transverse bridge of the holding element 5. Hence, the holding element 5 rests on the rail 2 by means of the damping element 10. Vibrations can thereby be damped during use of the vehicle line according to the invention. This also helps to reduce noise.

The holding element 5 forms a pocket-like recess 9 in which a bearing block 4 is guided in telescopic fashion and is adjustable in its height by means of a threaded element 6 (adjusting element).

The threaded element 6 is e.g. configured in the form of a screw which has an upper operating portion 7 (polygon, slot, or the like). The threaded element 6 may e.g. be provided with a round thread, which is guided in a threaded recess 16 of the bearing block 4.

On the top side of the bearing block 4 a plate-shaped element 3 is integrally connected to said block. Said element comprises a recess 8 in the area of the threaded element 6 so as to be able to adjust the threaded element 6. The recess 8 can be covered by means of a cover element 17, wherein, as shown in FIG. 5, neighboring plate-like elements 3 are closable by way of a common cover element 17 and are lockable relative to one another. It is thereby possible to achieve an additional fixation of the plate-shaped elements in the longitudinal direction of the rails 2.

The double-headed arrows in FIGS. 4 to 6 respectively show the vertical setting or adjusting option for the plate-shaped elements 3 relative to the rail 2.

It is possible for the use in a magnetic levitation train to provide a guiding bridge 18 on the top side of the plate-shaped elements, as shown in FIG. 3. Furthermore, it is possible to arrange power rails or levitation magnets 19, or the like, on the side portions of the plate-shaped elements; see the schematic illustration of a use of the plate-shaped element 3 according to the invention for a magnetic levitation vehicle, similar to the illustration according to FIG. 3.

LIST OF REFERENCE NUMERALS

1 substructure
2 rail
3 plate-shaped element
4 bearing block
5 holding element
6 threaded element adjusting element
7 operating portion
8, 9 recess
10 damping element
11 tie
12 bound
13 magnetic levitation vehicle
14 threaded recess
15 screw threaded bolt
16 threaded recess
17 cover element
18 guiding bridge
19 levitation magnet

The invention claimed is:

1. A vehicle line, comprising:

a substructure including an arrangement of plate-shaped elements;

at least two rails fastened to the substructure, wherein the at least two rails are parallel to each other;

holding elements respectively fastened to each of the at least two rails;

threaded elements, wherein each of the threaded elements is in abutment with a respective holding element, wherein each of the threaded elements is arranged on a respective bearing block;

wherein each of the threaded elements is a screw and partly passes through the plate-shaped element;

wherein a lateral lower portion of the plate-shaped elements includes the downwardly projecting bearing blocks, each of the bearing blocks being supported in a vertically adjustable manner on a respective holding element.

2. The vehicle line according to claim 1, wherein each of the threaded elements is provided with at least one of a round thread and an anti-twist device.

3. The vehicle line according to claim 1, wherein each of the threaded elements includes an upwardly oriented operating portion which is operable through a recess of the plate-shaped element.

4. The vehicle line according to claim 1, wherein each of the bearing blocks is arranged to be vertically displaceable in a recess of the respective holding element.

5. The vehicle line according to claim 1, wherein a damping element, is arranged between each of the at least two rails and the holding element.

6. The vehicle line according to claim 1, wherein the plate-shaped element is provided with at least one of power rails, levitation magnets, guiding magnets and linear motors.

7. A vehicle line, comprising:

a substructure including an arrangement of plate-shaped elements;

at least two rails fastened to the substructure, wherein the at least two rails are parallel to each other;

holding elements respectively fastened to each of the at least two rails;

threaded elements, wherein each of the threaded elements includes an upwardly oriented operating portion, and wherein each of the threaded elements is operable through a recess of the plate-shaped element;

wherein a lateral lower portion of the plate-shaped elements includes downwardly projecting bearing blocks, each of the bearing blocks being supported in a vertically adjustable manner on a respective holding element.

8. The vehicle line according to claim 7, wherein each of the threaded elements is in abutment with a respective holding element and is arranged on a respective bearing block.

9. The vehicle line according to claim 8, wherein each of the threaded elements is a screw and partly passes through the plate-shaped element.

10. The vehicle line according to claim 7, wherein each of the threaded elements are provided with at least one of a round thread and an anti-twist device.

11. The vehicle line according to claim 7, wherein each of the bearing blocks is arranged to be vertically displaceable in a recess of the respective holding element.

12. The vehicle line according to claim 7, wherein a damping element, is arranged between each of the at least two rails and the holding element.

13. The vehicle line according to claim 7, wherein the plate-shaped element is provided with at least one of power rails, levitation magnets, guiding magnets and linear motors.

14. A vehicle line, comprising:

a substructure including an arrangement of plate-shaped elements;

at least two rails fastened to the substructure, wherein the at least two rails are parallel to each other;

holding elements respectively fastened to each of the at least two rails, wherein a lateral lower portion of the plate-shaped elements includes downwardly projecting bearing blocks, each of the bearing blocks being supported in a vertically adjustable manner on a respective holding element such that each of the bearing blocks is vertically displaceable in a recess of the respective holding elements.

15. The vehicle line according to claim 14, further including threaded elements, wherein each of the threaded elements is in abutment with a respective holding element and is arranged on a respective bearing block.

16. The vehicle line according to claim 15, wherein each of the threaded elements is a screw and at least partly passes through the plate-shaped element.

17. The vehicle line according to claim 15, wherein each of the threaded elements is provided with at least one of a round thread and an anti-twist device.

18. The vehicle line according to claim 15, wherein each of the threaded elements includes an upwardly oriented operating portion which is operable through a recess of the plate-shaped element.

19. The vehicle line according to claim 14, wherein a damping element, is arranged between each of the at least two rails and the holding element.

20. The vehicle line according to claim 14, wherein the plate-shaped element is provided with at least one of power rails, levitation magnets, guiding magnets and linear motors.

* * * * *